US008287401B2

(12) United States Patent
Tateno et al.

(10) Patent No.: US 8,287,401 B2
(45) **Date of Patent: *Oct. 16, 2012**

(54) PUTTER HEAD

(75) Inventors: Atsuo Tateno, Tokyo (JP); Tatsuya Ishikawa, Tokyo (JP); Wataru Ban, Saitama (JP); Fumiaki Sato, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 9 days.

This patent is subject to a terminal disclaimer.

(21) Appl. No.: 11/930,887

(22) Filed: Oct. 31, 2007

(65) Prior Publication Data

US 2008/0125241 A1 May 29, 2008

(30) Foreign Application Priority Data

Nov. 28, 2006 (JP) ..... P2006-320356
Dec. 27, 2006 (JP) ..... P2006-351578

(51) Int. Cl.
*A63B 53/04* (2006.01)

(52) U.S. Cl. ..... 473/331; 473/340; 473/342

(58) Field of Classification Search ..... 473/324–350
See application file for complete search history.

(56) References Cited

U.S. PATENT DOCUMENTS

| | | | | | |
|---|---|---|---|---|---|
| 4,530,505 | A * | 7/1985 | Stuff | 473/250 |
| 5,255,918 | A * | 10/1993 | Anderson et al. | 473/330 |
| 5,472,201 | A * | 12/1995 | Aizawa et al. | 473/329 |
| 5,637,044 | A | 6/1997 | Swash | |
| 5,688,186 | A | 11/1997 | Michaels et al. | |
| 6,224,497 | B1 | 5/2001 | Antonious | |
| 6,231,458 | B1 * | 5/2001 | Cameron et al. | 473/332 |
| 6,287,215 | B1 * | 9/2001 | Fisher | 473/309 |
| 6,729,972 | B2 * | 5/2004 | Boord | 473/340 |
| 6,743,117 | B2 * | 6/2004 | Gilbert | 473/332 |
| 6,860,822 | B2 * | 3/2005 | Vrska, Jr. | 473/324 |
| 7,048,648 | B2 * | 5/2006 | Breier et al. | 473/340 |
| 7,144,335 | B2 * | 12/2006 | Breier et al. | 473/340 |
| 7,166,039 | B2 * | 1/2007 | Hettinger et al. | 473/331 |
| 7,267,620 | B2 * | 9/2007 | Chao et al. | 473/342 |
| 7,278,926 | B2 * | 10/2007 | Frame | 473/329 |
| 7,285,057 | B2 * | 10/2007 | Mann et al. | 473/331 |
| 2006/0154739 | A1 | 7/2006 | Mann, Jr. et al. | |

FOREIGN PATENT DOCUMENTS

| | | | |
|---|---|---|---|
| GB | 2 401 798 | A | 11/2004 |
| JP | 61-240978 | A | 10/1986 |
| JP | 6-19760 | U | 3/1994 |
| JP | 06-079023 | A | 3/1994 |
| JP | 9-253250 | A | 9/1997 |
| JP | 09253250 | A * | 9/1997 |
| JP | 10-507383 | A | 7/1998 |

(Continued)

OTHER PUBLICATIONS

United Kingdom Search Report dated Mar. 11, 2008.

(Continued)

*Primary Examiner* — Alvin Hunter
(74) *Attorney, Agent, or Firm* — Sughrue Mion, PLLC

(57) ABSTRACT

A putter head includes: a face; a first group of grooves which are mutually-parallel grooves; and a second group of grooves which differ in depth from the first group of grooves, wherein the face includes the first group of grooves and the second group of grooves.

12 Claims, 7 Drawing Sheets

FOREIGN PATENT DOCUMENTS

| | | | | |
|---|---|---|---|---|
| JP | 10179815 | A | * | 7/1998 |
| JP | 11-137746 | A | | 5/1999 |
| JP | 2000-254256 | A | | 9/2000 |
| JP | 2002153575 | A | * | 5/2002 |
| JP | 2002-315857 | A | | 10/2002 |
| JP | 2003-000777 | A | | 1/2003 |
| JP | 2004-236985 | A | | 8/2004 |
| JP | 2005-296204 | A | | 10/2005 |
| WO | 96/11728 | A1 | | 4/1996 |

OTHER PUBLICATIONS

Japanese Office Action issued Sep. 8, 2011 in corresponding Japanese Patent Application No. 2006-351578.

Communication, issued by the Japanese Patent Office in corresponding Japanese Application No. 2006-351578 on Jan. 17, 2012.

* cited by examiner

PUTTER HEAD

BACKGROUND OF THE INVENTION

1. Field of the Invention

The present invention relates to a golf putter head, and more particularly, to a putter head having grooves formed in a face.

2. Description of the Related Art

A putter head is a golf club used for putting a ball on a green. As described in JP-A-2003-777, a putter golf head including so-called milled grooves formed over an entire face is popular, wherein the grooves are formed by means of cutting operation of a milling machine so as to assume a circular-arc shape of uniform pitch when viewed from the front of the face. The reason for forming the grooves is that soft feeling is acquired as a result of a reduction in a contact area between the head and the golf ball; that slippage of the ball is less likely to arise while the face remains wet because of rain or dew; that appearance of the head is enhanced by a design-like pattern. Thus, various advantages are yielded. These advantages are often seen in a putter golf club head for use with a high-grade golfer which places an emphasis on feeling of hitting or a feel of the club.

JP-A 2003-777 provide descriptions of: setting a groove pitch to 0.3 to 3 mm; setting the depth of grooves to 0.03 to 0.3 mm; and setting a radius of a circular arc of a circular-arc groove to 8 to 80 mm.

SUMMARY OF THE INVENTION

A putter head usually has a loft angle of about 2° to 5°. A picture taken by a high-speed camera shows that a golf ball is usually remains in a backspin state immediately after an impact. The backspin deteriorates the rotation of the ball. The present invention aims at providing a putter head improved to reduce the backspin.

According to a first aspect of the invention, there is provided a putter head including: a face; a first group of grooves which are mutually-parallel grooves; and a second group of grooves which differ in depth from the first group of grooves, wherein the face includes the first group of grooves and the second group of grooves.

According to a second aspect of the invention according to the first aspect of the invention, a ratio W/S between a width W (mm) of grooves of the first group and a pitch S (mm) between the grooves of the first group ranges 0.5 to 2.0.

According to a third aspect of the invention according to the second aspect of the invention, the width W of grooves of the first group ranges from 0.5 to 1.6 mm.

According to a fourth aspect of the invention according to any one of the first to third aspect of the invention, the depth H of the grooves of the first group ranges from 0.03 to 1.2 mm and the depth of the grooves of the second group ranges from 0.01 to 0.3 mm.

According to a fifth aspect of the invention according to any one of the first to fourth aspect of the invention, a cross-sectional profile of the groove of the first group is a rectangular shape or an U-shaped form.

According to a sixth aspect of the invention according to any one of the first to fifth aspect of the invention, the grooves of the first group and the grooves of the seconds group extend in different directions.

According to a seventh aspect of the invention according to the sixth aspect of the invention, the grooves of the second group are formed from milled grooves.

According to an eighth aspect of the invention according to any one of the first to seventh aspect of the invention, each of the grooves of the second group assumes an essentially-circular-arc shape.

According to a ninth aspect of the invention according to any one of the first to eighth aspect of the invention, a face is formed from an insert material which differs from a material of a main body.

According to a tenth aspect of the invention according to the ninth aspect of the invention, the insert material is constituted of a laminate member formed by laminating plural materials.

According to a eleventh aspect of the invention according to any one of the first to tenth aspect of the invention, at least one layer of the laminate member is formed from metal and at least another layer is formed from a synthetic resin, rubber, or an elastomer.

Results of the research conducted by the present inventors show that backspin is reduced as a result of a decrease in a contact area between a face and a ball. Further, a hit mark on the face made when the putter hits a golf ball was examined by affixing pressure-sensitive paper on the face of the patter head. A hit mark having a diameter of about 2 to 3 mm was ascertained to be left. When the ball was hit over a long distance, a hit mark having a diameter of about 5 mm was ascertained to be left. A little change in the shape of the ball was also found.

Accordingly, grooves analogous to corrugations formed in an iron head were formed in the face. The amount of initial backspin of the ball was examined, to thus determine the amount of rolling. The examination shows that, since head speed generated by an iron head is far faster than head speed generated by the putter head, the ball is engaged with the corrugations (grooves), and hence the amount of backspin is considered to increase. However, in the case of the putter head, the amount of backspin is found to decrease conversely.

The present invention is conceived on the basis of the above findings.

In the present invention, there are provided a plurality of groups of grooves including at least first and second groups of grooves extending in different directions. Hence, a contact area between the face and the ball becomes small, and the amount of backspin decreases.

In the present invention, grooves extending in different directions are provided, and the number of grooves is large. Hence, when the grooves are formed by means of cutting, machining involves consumption of much time. When a grooved putter head is formed by means of casting and when both the first and second groups of grooves are deep, it may be the case where the flow of hot water between the grooves becomes worse and where a percent defective increases.

Accordingly, in the present invention, the grooves of the first group and the grooves of the second group are made different from each other in terms of a depth, to thus facilitate manufacture of a putter head.

As mentioned above, in the case of the putter head of the present invention, the amount of backspin of the ball caused when the ball is hit is reduced. Hence, the ball causes overspin at an early stage where the ball rolling on the green has departed from the face. The ball smoothly rolls along an intended line. Moreover, when the grain of the grass on the green is against the golfer, occurrence of a significant short (a long distance is left between the stopped ball and the cup), which would otherwise be caused when a shot has unexpectedly failed to carry far, can be prevented. According to the present invention, the face is formed from an insert whose material is different from the material of the main body. As a result, feeling of hitting can be adjusted.

DETAILED DESCRIPTION OF THE EMBODIMENTS

An embodiment of the present invention will be described hereunder by reference to the drawings.

Figure 1:
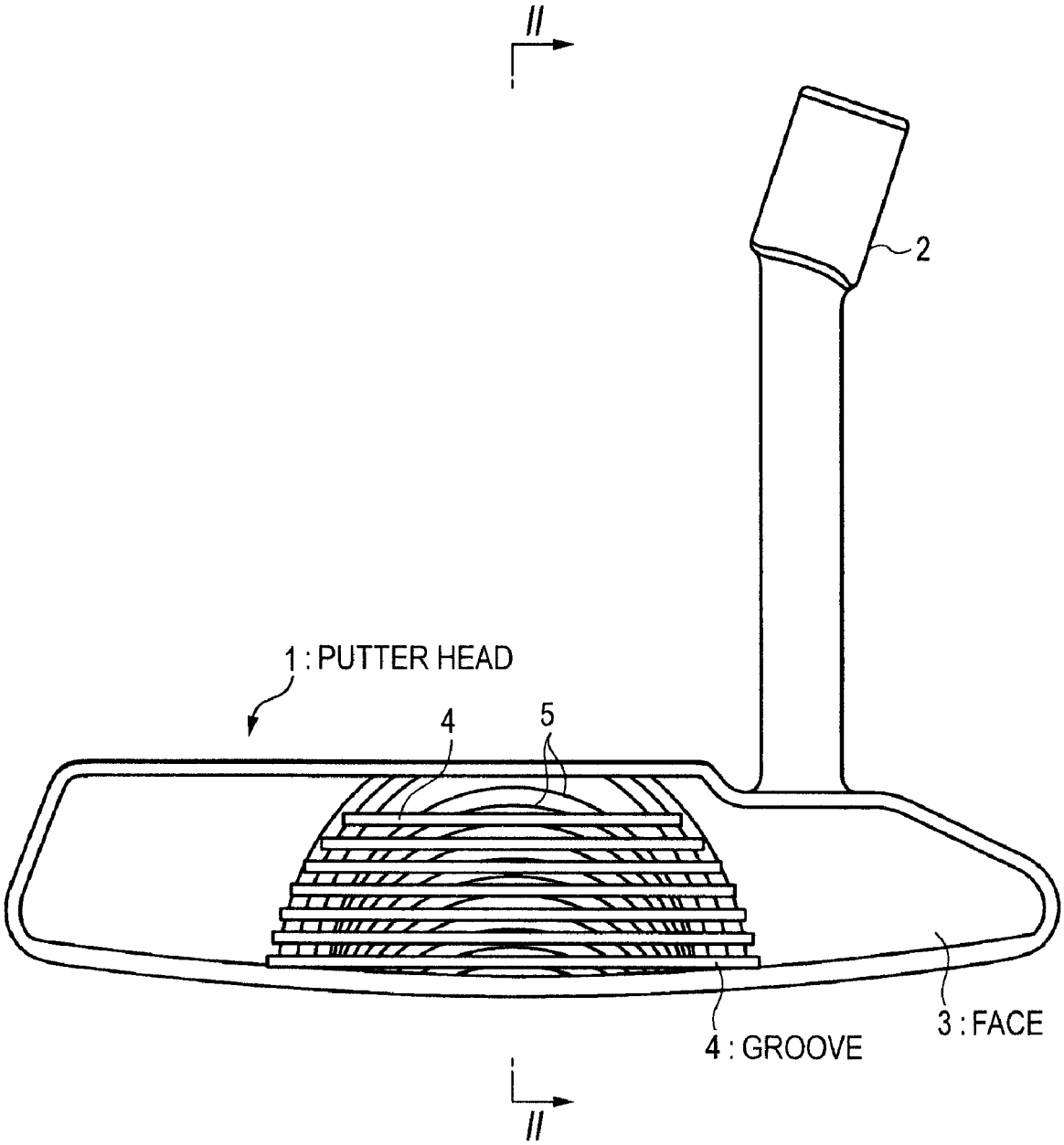
FIG. 1 is a front view of a putter head of an example.
Figure 2:
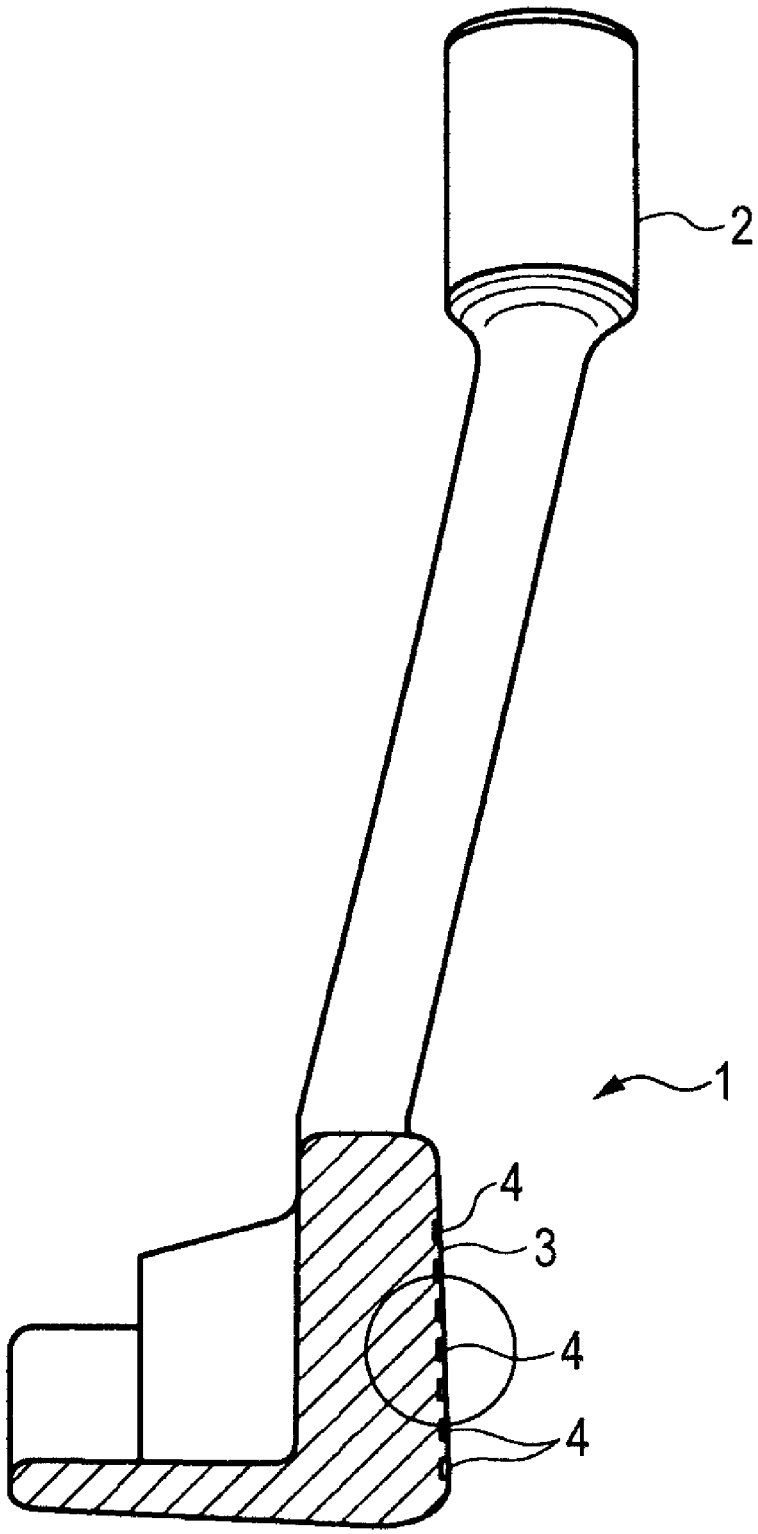
FIG. 2 is a cross-sectional view taken along line II-II shown in FIG. 1.
Figure 3:
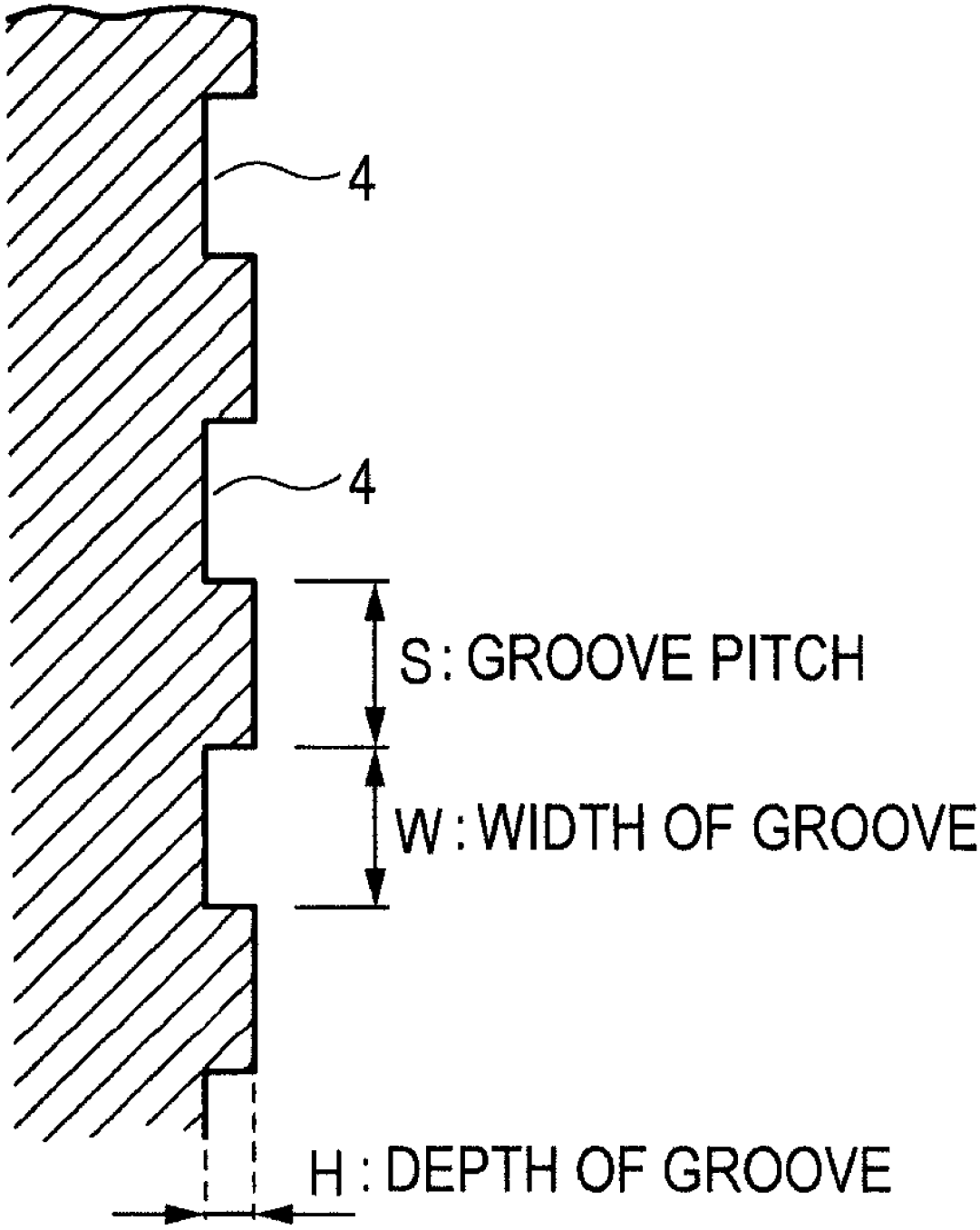
FIG. 3 is an enlarged view of a part of FIG. 2.

FIG. 1 is a front view of a putter head of an embodiment;

FIG. 2 is a cross-sectional view taken along line II-II shown in FIG. 1; and FIG. 3 is an enlarged view of a face shown in FIG. 2.

This putter head 1 is realized by inserting a shaft (omitted from the drawings) into a hosel 2 and fixing the inserted shaft by means of an adhesive.

A plurality of grooves 4 extending along a direction from a tow to a heel are formed, as a first group of grooves, in parallel in a face 3 of this putter head 1. Grooves 5 of a second group formed into milled grooves of an essentially, circular-arc shape are provided on the face 3.

The grooves 4 extend in a horizontal direction in a sole state where a sole face of the putter head 1 remains in contact with a horizontal center plane of the sole face along the direction from the tow to the heel. The longitudinal center of the grooves 4 lies in the vicinity of the center of the putter head 1 along the direction from the tow to the heel.

The length of the groove 4 is preferably 5 mm or more, particularly 30 mm or more. The grooves 4 may be present over the entire length of the face 3 along the direction from the tow to the heel. The number of the grooves 4 is preferably three or more, particularly about 3 to 30.

A distance from the lower edge of the lowermost groove 4 and the sole face of the putter head 1 is preferably 10 mm or less. When the grooves are present at positions higher than a point at which a ball contacts at the time of putting, an effect of reducing a backspin cannot be yielded.

The width, groove pitch, depth, and cross-sectional profile of the groove 4 of the first group will now be described.

In the present invention, a ratio W/S between a width W and a groove pitch S of the groove 4 of the first group is preferably 0.5 to 2, more preferably 0.5 to 1.5, and particularly, preferably 0.6 to 1.3. When the W/S ratio is smaller than 0.5, difficulty is encountered in forming grooves. In contrast, when the width of the groove becomes greater than 2, it may be the case where the ball contacts only an area where no grooves are formed or a grooved area, which is likely to cause variations in a distance over which the ball rolls.

The width W of the groove 4 of the first group is preferably 0.5 to 1.6 mm, particularly 0.5 to 1.25 mm, and more particularly 0.75 to 1.25 mm. When the width of the groove is less than 0.5 mm, difficulty is encountered in forming the grooves. For this reason, the width is set to a value of 0.5 mm or more. The reason for setting the width to 1.6 mm or less is that a hit mark of the ball has a diameter of about 2 mm to 5 mm. When the width of the groove is greater than 1.6 mm, it may be the case where edges of the grooves are likely to cause variations in a distance over which the ball rolls.

The groove pitch S of the groove 4 of the first group is preferably 0.25 mm to 3.2 mm, particularly 0.25 mm to 2.5 mm. When the groove pitch S is smaller than 0.5 mm, difficulty is encountered in forming grooves.

The grooves 4 are intended for reducing the contact area between the face 3 and the ball. Accordingly, the effect of reduction of the contact area remains unaffected as the grooves 4 have a larger depth. However, the depth of the groove 4 is preferably 1.2 mm or less. When the diameter of the hit mark is about 2 to 3 mm, the ball is deformed by an amount of 0.03 mm or thereabouts. For this reason, the grooves 4 preferably have a depth of 0.03 mm or more.

The cross-sectional profile of the groove 4 of the first group may be any one of a V-shaped groove, a U-shaped groove, and an angular groove. However, even when the ball has become deformed, a contact area between U-shaped grooves or angular grooves and the face remains essentially unchanged. Accordingly, these grooves are preferable. Moreover, when angular portions by means of which the face contacts the grooves are rounded, the influence of a backspin preferably becomes small.

Figure 4:
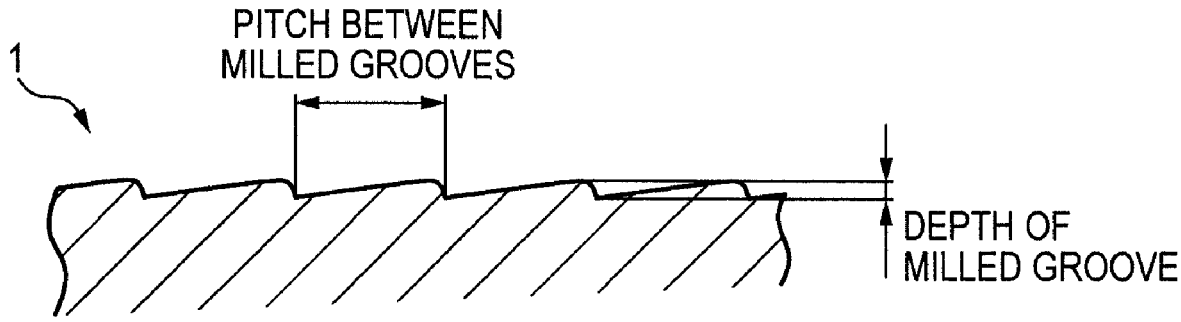
FIG. 4 is a cross-sectional view of a neighborhood of a face for describing a milled groove.
Figure 5:
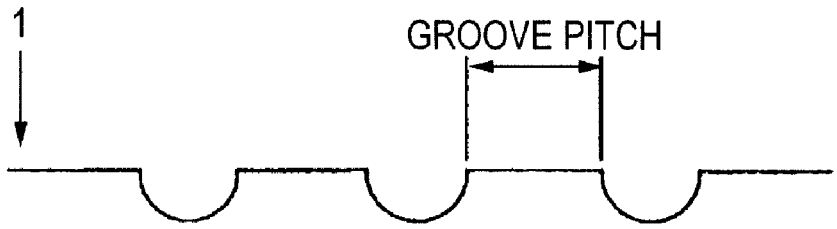
FIG. 5 is a descriptive view of a cross-sectional profile of a groove 5 of the embodiment.

The depth of the groove 5 of the second group is preferably smaller than the depth of the groove 4 of the first group; and preferably assumes a value of 0.01 to 0.3 mm, particularly a value of 0.03 to 0.1 mm. The grooves 5 of the second group may also be a milled groove. FIG. 4 shows a definition about the depth and pitch of the groove 5 formed as a milled groove. The groove 5 may also assume a U-shaped cross-sectional profile or a semicircular cross-sectional profile shown in FIG. 5 or may be an angular groove.

Each of the grooves 5 is formed continually as a circular arc of a single radius. Centers of the circles are aligned to a straight line. The centers of the circular arcs are preferably situated at the center of the face 2 along the direction from the tow to the heel. The grooves 5 are provided in at least the area where the grooves 4 of the first group are present.

In the present embodiment, the grooves of the first group are formed in the horizontal direction. However, the grooves of the first group may also be formed in the vertical direction. In this case, the width, groove pitch, W/S of the groove are the same as those mentioned previously. In the case of the vertical grooves, the length of the grooves is preferably 5 mm or more. In the case of the vertical grooves, the grooves are preferably formed in at least the center area on the face along the direction from the tow to the heel. The length of the center area along the direction from the tow to the heel is preferably 5 mm or more.

The material of the putter head of the present invention is an arbitrary material such as metal, a synthetic resin, rubber, ceramic, carbon, and the like. Moreover, only the face may also be formed from a material differing from a material of a main body of the putter head.

In the present embodiment, the grooves 4 are linear but may be formed into a circular-arc shape or a curved shape. Moreover, both horizontal grooves and vertical grooves may also be provided simultaneously.

In the present embodiment, the grooves 5 of the second group are formed as milled grooves. However, grooves formed from V-shaped grooves, U-shaped grooves, or angular grooves may also be formed by cutting or casting.

Figure 6:
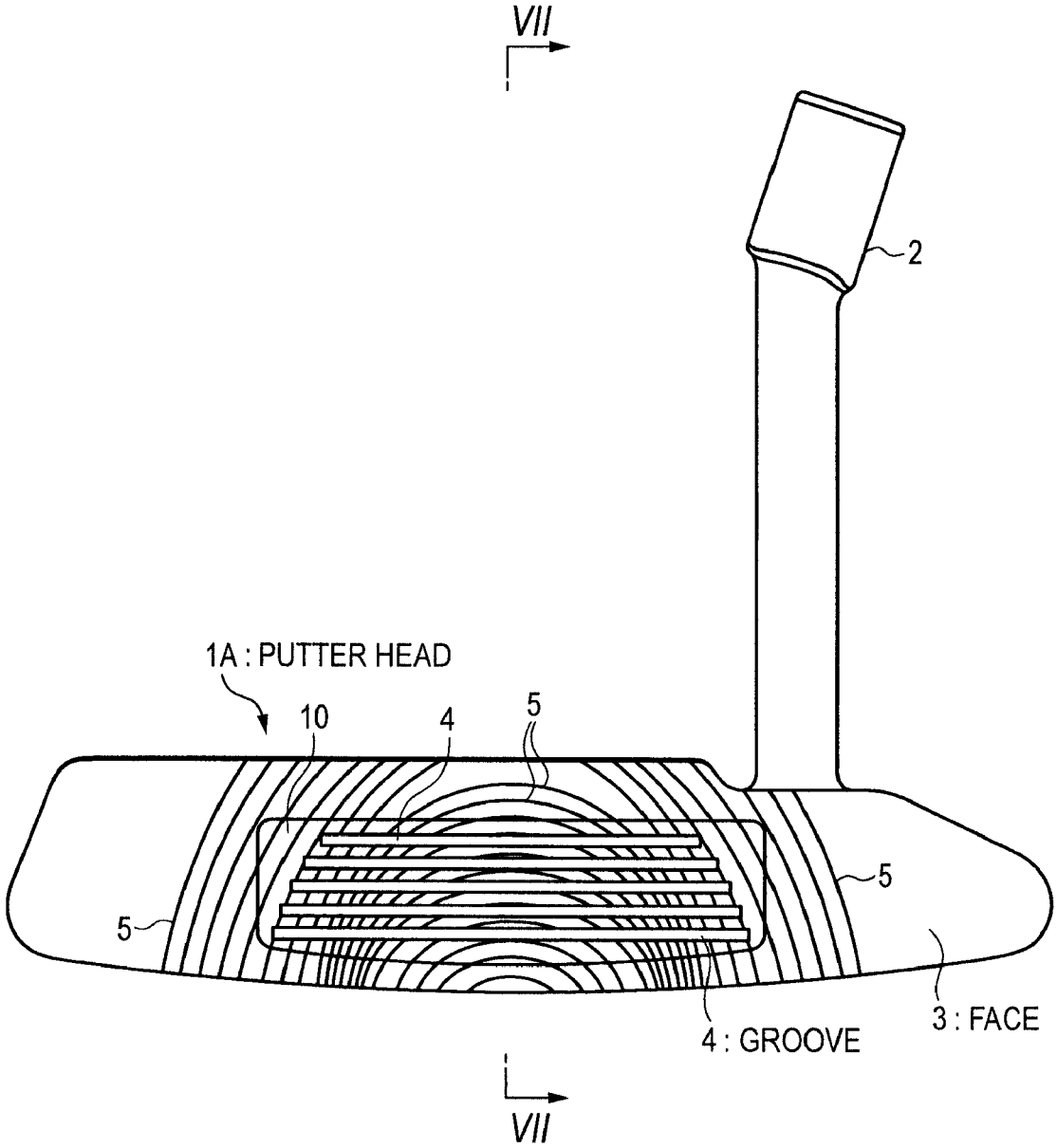
FIG. 6 is a front view of a putter head of another example.
Figure 7:
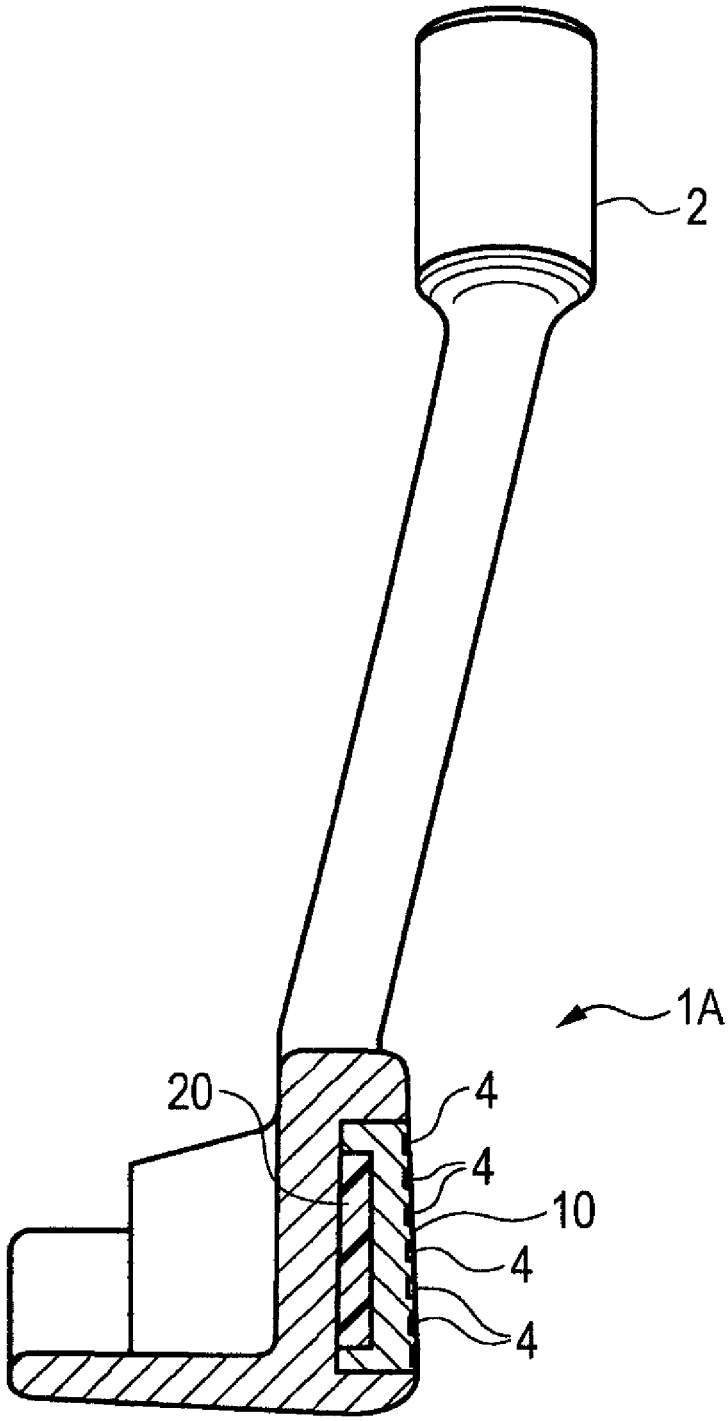
FIG. 7 is a cross-sectional view taken along line VII-VII shown in FIG. 6.
Figure 8:
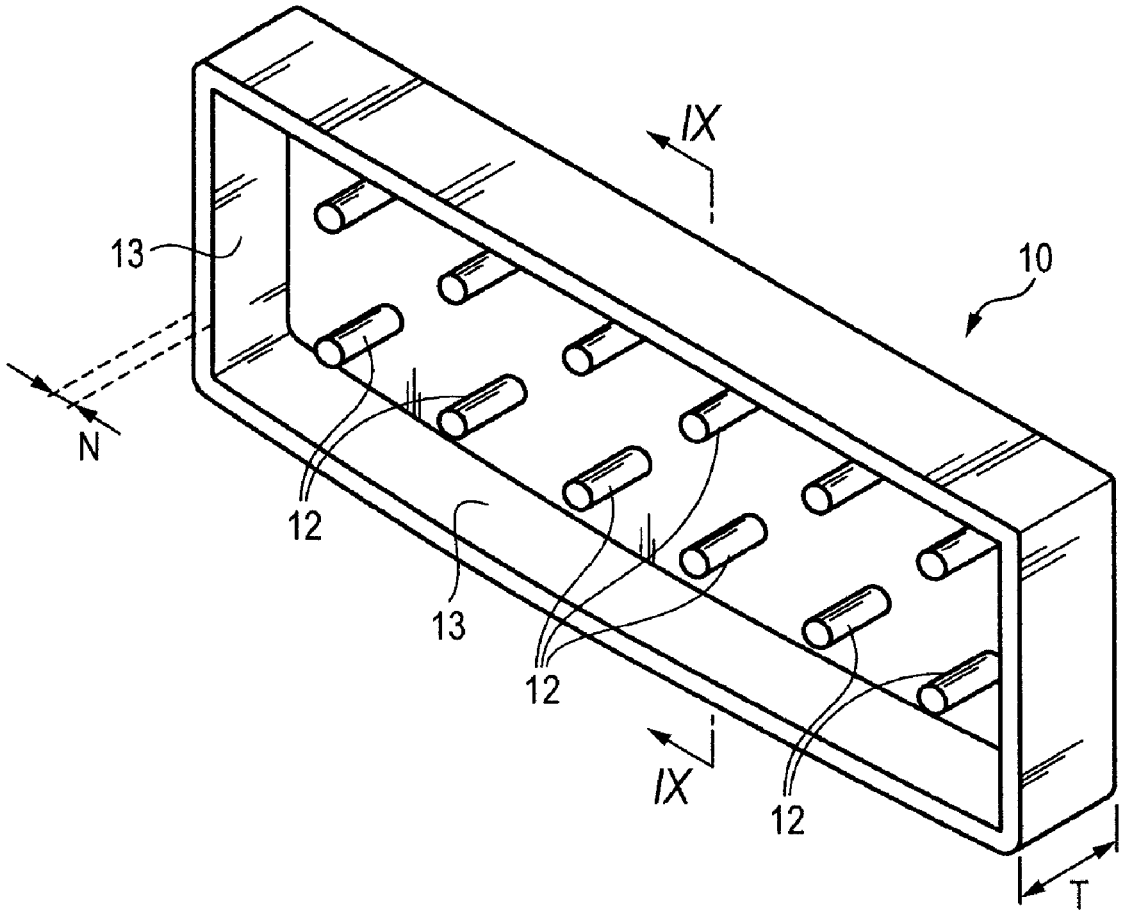
FIG. 8 is a perspective view of a first insert.
Figure 9:
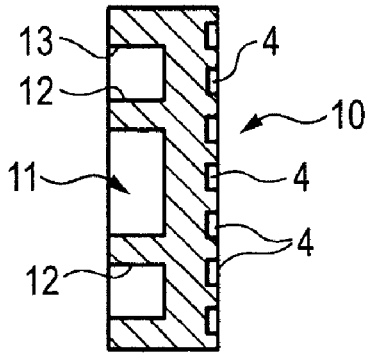
FIG. 9 is a cross-sectional view taken along line IX-IX shown in FIG. 8.

An embodiment in which a face is formed from an insert will be described by reference to FIGS. 6 through 9. FIG. 6 is a front view of a putter head 1A; FIG. 7 is a cross-sectional view taken along line VII-VII shown in FIG. 6; FIG. 8 is a perspective view of the insert when viewed from the back; and FIG. 9 is a cross-sectional view taken along IX-IX shown in FIG. 8. The putter head 1A is identical with the putter head 1 except of the inserts 10 and 20 being provided on the face. Like reference numerals designate like elements.

The first insert 10 is an essentially-rectangular plate whose rear surface is contoured into a recess 11. The grooves 4 are formed in the front surface of the insert 10.

A plurality of pillar, more preferably columnar, protrusions 12 (12 protrusions in the present embodiment) are provided upright on the rear surface of the insert 10 corresponding to the bottom of the recess 11. Tip ends of the protrusions 12 are flush with the rear surface of a circumferential wall section 13 enclosing the recess 11.

The overall thickness T of the insert 10 preferably ranges from 2 to 6 mm; the depth of the recess 11, that is, the height of the protuberance 12, preferably ranges from 1 to 3 mm; the number of protuberances 12 preferably ranges from 10 to 30; the diameter of the protuberance 12 preferably ranges from 1 to 3 mm; and the thickness N of the circumferential wall 13 preferably ranges from 1 to 3 mm or thereabouts. The length of the insert 10 along the direction from the tow to the heel preferably ranges from 40 to 100 mm or thereabouts; and the height of the insert 10 preferably ranges from 10 to 30 mm or thereabouts.

In the present embodiment, the recess 11 is filled with a second insert 20 formed from a synthetic resin, rubber, or elastomer. The insert 10 formed by means of filling the recess 11 with the second insert 20 is fittingly bonded to the recess of the head main body by way of an adhesive. In conjunction with the use of the adhesive or in place of the use of the adhesive, broadening the inside of the recess and narrowing the entrance of the recess may also be performed in order to make removal of the insert from the recess hard. Moreover, when pieces of metal or pieces of ceramic are fixed together, a fixing technique, such as caulking, welding, brazing, and the like, may also be adopted.

As mentioned above, sensational elements, such as the feeling of hitting, a feel, a touch, and the like, generated by the putter head 1A, can be adjusted by means of providing the face with the inserts 10 and 20.

Metal, such as titanium, a titanium alloy, stainless steel, soft iron, aluminum, an aluminum alloy, noble metal, and the like, are preferable as the first insert 10. However, rubber, a synthetic resin, and the like, may also be adopted, or ceramic, carbon, and the like, may also be adopted.

Polyurethane, nylon, polyester, polycarbonate, and the like, are preferable as a synthetic resin used for forming the second insert 20. Silone rubber, chloroprene rubber, nitrile rubber, natural rubber, styrene-butadiene rubber, and the like, are preferable as rubber used for forming the second insert 20. Styrene-based elastomer, urethane-based elastomer, ethylene-based elastomer, polyester-based elastomer, olefin-based elastomer, amid-based elastomer, and the like, are preferable as an elastomer used for forming the second insert 20. Shore A hardness of this synthetic resin preferably ranges from 90 to 98 or thereabouts, and the Shore A hardness of rubber and elastomer preferably ranges from 20 to 30 or thereabouts.

In the present invention, the second insert 20 may be omitted, and only the first insert 10 may be provided.

An example and comparative examples are described hereunder.

COMPARATIVE EXAMPLES 1 THROUGH 4

Evaluation was performed by means of using a pin-type putter head (a material: stainless steel SUS304) having a loft angle of 4° as a putter head.

In Comparative Example 1, the grooves 4 or 5 were not provided at all.

In Comparative Examples 2 through 4, only the grooves 4 were provided, but the grooves 5 were not provided.

Specifically, a first group of linear grooves 4 were formed in the number of six in an area on the face which hits a ball (i.e., an intermediate area of the face along the direction from the tow to the heel) as illustrated. The grooves were formed into angular grooves by means of machining. The groove 4 located at the lowermost position is the longest; namely, assumes a length of 54 mm. The groove 4 located at the highest position is the shortest; namely, assumes a length of 37 mm.

The groove 4 has a width of 0.75 mm and a depth of 0.4 mm. The groove pitch is set as shown in Table 1.

A steel shaft was attached to each of the putter heads, whereby the length of the putter clubs comes to 34 inches. The top-ranked amateur golfer (a high-grade golfer) hit a golf ball over a distance of 2.5 m by use of the putter of Comparative Example 1. Balls were put, by means of the putter clubs of Comparative Examples 2 through 4, with the same swing and at the same head speed as those achieved in the case of Comparative Example 1, thereby rolling the balls on the actual green. Pictures of putting of the balls was taken by means of a high-speed camera, and the amount of spin of the balls was measured. The balls flied over a slight distance immediately after having been hit, and subsequently landed and rolled on the green. Test results are provided in Table 1. A unit "rpm" in the table designates the number of rotations of the ball per minute.

TABLE 1

| No. | W (mm) | S (mm) | W/S (—) | Amount of initial back spin (rpm) | Amount of forward spin achieved immediately after landing (rpm) | Rolled distance (m) | Remarks |
|---|---|---|---|---|---|---|---|
| Comparative Example 1 | — | — | — | 28 | 276 | 2.51 | No grooves |
| Comparative Example 2 | 0.75 | 1.5 | 0.5 | 24 | 319 | 2.59 | H = 0.4 mm |
| Comparative Example 3 | 0.75 | 0.75 | 1.0 | 16 | 340 | 2.70 | |
| Comparative Example 4 | 0.75 | 0.5 | 1.5 | 10 | 360 | 2.79 | |

As shown in Table 1, the putter head having grooves 4 generates a smaller amount of initial back spin. The amount of forward spin achieved after landing is increased, and the ball spins well. Thus, a rolled distance is increased.

COMPARATIVE EXAMPLES 5 TO 7

Next, a test was conducted by use of the putter heads which are the same as those of Comparative Examples 2 to 6 except of W/S being set to a constant value of 0.9 and the width of the groove being changed. An effect of the width of the groove was examined.

Specifically, a putter head (Comparative Example 5) having W=0.75 mm, S=0.83 mm, W/S=0.9, and H=0.4 mm and a putter head (Comparative Example 6) having W=1.25 mm, S 1.39 mm, W/S=0.9, and H=0.4 mm were used.

The test was conducted with the same swing as that achieved when the putter of Comparative Example 1 hit the ball over a distance of 4.8 m.

For comparison purpose, the putter head identical with the putter head of Comparative Example 1 was tested under the same conditions (Comparative Example 7). Test results are provided in Table 2.

EXAMPLE 1

In Comparative Example 5, grooves 5 which are narrower and shallower than the grooves 4 in terms of a width and a depth were provided. The grooves 5 were formed into U-shaped grooves having a depth of 0.075 mm and a width of 0.39 mm. Circular-arc grooves having the same radius were provided, and the center of the circle was shifted at pitches of 1.2 mm in the vertical direction, whereby a plurality of grooves were formed. Results of tests conducted under the same conditions as those of Comparative Examples 5 through 7 are also provided in Table 2.

TABLE 2

| No. | W (mm) | S (mm) | W/S (—) | Amount of initial back spin (rpm) | Amount of forward spin achieved immediately after landing (rpm) | Rolled distance (m) | Remarks |
|---|---|---|---|---|---|---|---|
| Comparative Example 5 | 0.75 | 0.83 | 0.9 | 27 | 277 | 4.89 | H = 0.4 mm |
| Comparative Example 6 | 1.25 | 1.39 | 0.9 | 9 | 289 | 5.07 | |
| Comparative Example 7 | — | — | — | 42 | 232 | 4.80 | No grooves |
| Example 1 | 0.75 | 0.83 | 0.9 | 6 | 294 | 5.24 | H = 0.4 mm |

Besides, Example 1 is a putter club fabricated by additionally milling the putter club of Comparative Example 7.

As shown in Table 2, both Comparative Examples 5 and 6 show a reduction in the amount of backspin as compared with the amount of backspin generated by Comparative Example 7, as well as showing an increase in rolled distance as compared with the rolled distance achieved by Comparative Example 7.

Example 1 shows a smaller amount of backspin when compared with the amount of backspin achieved by Comparative Example 5, as well as showing a superior rolled distance.

EXAMPLE 2

The putter head 1A shown in FIGS. 6 to 9 were fabricated by use of the first insert 10 and the second insert 20. The heads were provided for trial putting by the golfer, and resultant feelings of hitting were summated. In relation to Nos. 1 and 2, the second insert was omitted, and only the first insert 10 was used.

Dimensions of individual portions of the first insert 10 are as follows:

Length achieved along the direction from the tow to the heel: 60 mm

Height: 14 mm

Thickness T: 4 mm

Thickness N of circumferential wall section; 1.5 mm

Depth of recess 11: 2 mm

Combinations of materials of the insert are as follows. In Nos. 3 through 8, a material on the left side of "+" sign is a material of the first insert, and a material on the right side of the same is a material of the second insert.

No. 1: Only the first insert 10 made of stainless steel

No. 2: Only the first insert 10 made of an aluminum alloy

No. 3: Stainless steel+High hardness resin

No. 4: Aluminum alloy+High hardness resin

No. 5: Stainless steel+rubber

No. 6: Aluminum alloy+rubber

No. 7: High hardness resin+rubber

No. 8: High hardness resin+High hardness resin

SUS304 was used as stainless steel, and 6061 was used as an aluminum alloy. An urethane resin having Shore A hardness 95 was used as a high hardness resin. Nitrile rubber having Shore A hardness 25 was used as rubber.

Ranks achieved by evaluation of softness of the feeling of hitting are arranged in sequence from softer to harder, whereby adjustment of the feeling of hitting was ascertained. When the degree of likability achieved by 18 golfers was examined. No. 8 gained the highest likability. No. 8 is followed by, in sequence, No. 5, No. 6, Nos. 1 and 2 (gained the same rank), No. 3, and No. 7.

What is claimed is:

1. A golf club comprising:

a putter head comprising:

a face;

a first group of grooves which are mutually-parallel grooves; and a second group of grooves which differ in depth from the first group of grooves, wherein the face includes the first group of grooves and the second group of grooves, and wherein a ratio W/S between a width W (mm) of grooves of the first group and a pitch S (mm) between the grooves of the first group ranges from 0.5 to 2.0;

wherein the face is formed from an insert material which differs from a material of a main body; and a second insert material is made of a synthetic resin having Shore A hardness falling within a range from 90 to 98.

2. The golf club according to claim 1, wherein the face has a loft angle between 2° and 5°.

3. The golf club according to claim 1, wherein the insert material is fixed by an adhesive.

4. The golf club according to claim 1, wherein the insert material is fixed by at least one of fixing techniques of caulking, welding, and brazing.

5. The golf club according to claim 1, further comprising a second insert material fitted into a recess of the insert material so that second insert material is sealed by the insert material and the main body.

6. The golf club according to claim 1, wherein the insert material has a rectangular shape.

7. A golf club comprising:

a putter head comprising:

a face;

a first group of grooves which are mutually-parallel grooves; and a second group of grooves which differ in depth from the first group of grooves, wherein the face includes the first group of grooves and the second group of grooves, and wherein a ratio W/S between a width W (mm) of grooves of the first group and a pitch S (mm) between the grooves of the first group ranges from 0.5 to 2.0;

wherein the face is formed from an insert material which differs from a material of a main body; and a second insert material is made of a rubber having Shore A hardness falling within a range from 20 to 30.

8. The golf club according to claim 7, wherein the face has a loft angle of between 2° and 5°.

9. The golf club according to claim 7, wherein the insert material is fixed by an adhesive.

10. The golf club according to claim 7, wherein the insert material is fixed by at least one of fixing techniques of caulking, welding, and brazing.

11. The golf club according to claim 7, further comprising a second insert material fitted into a recess of the insert material so that second insert material is sealed by the insert material and the main body.

12. The golf club according to claim 7, wherein the insert material has a rectangular shape.

* * * * *